US009612607B2

(12) United States Patent
Kumar et al.

(10) Patent No.: US 9,612,607 B2
(45) Date of Patent: Apr. 4, 2017

(54) BANDGAP CIRCUIT FOR CURRENT AND VOLTAGE

(71) Applicant: Texas Instruments Incorporated, Dallas, TX (US)

(72) Inventors: Ajay Kumar, Phoenix, AZ (US); Rahul Bhandarkar, Austin, TX (US)

(73) Assignee: TEXAS INSTUMENTS INCORPORATED, Dallas, TX (US)

( * ) Notice: Subject to any disclaimer, the term of this patent is extended or adjusted under 35 U.S.C. 154(b) by 459 days.

(21) Appl. No.: 13/929,772

(22) Filed: Jun. 27, 2013

(65) Prior Publication Data

US 2015/0002130 A1 Jan. 1, 2015

(51) Int. Cl.
*G05F 3/08* (2006.01)
*G05F 3/30* (2006.01)

(52) U.S. Cl.
CPC . *G05F 3/30* (2013.01); *G05F 3/08* (2013.01)

(58) Field of Classification Search
CPC ... G05F 3/30; G05F 3/08; G05F 1/468; G05F 3/16
See application file for complete search history.

(56) References Cited

U.S. PATENT DOCUMENTS 5,125,112 A * 6/1992 Pace ..... G05F 3/30 331/176
5,818,292 A * 10/1998 Slemmer ..... G11C 5/143 323/313
6,285,244 B1 * 9/2001 Goldberg ..... G05F 3/30 323/314
6,870,421 B2 * 3/2005 Abe ..... H03F 3/343 327/513
7,224,227 B1 * 5/2007 Kumar ..... H03F 1/30 330/255
2005/0088163 A1 * 4/2005 Tachibana ..... G05F 3/30 323/313

(Continued)

OTHER PUBLICATIONS

Wenguan Li et al, "A Low Power CMOS Bandgap Voltage Reference with Enhanced Power Supply Rejection", IEEE International Conference on ASIC, 2009, ASICON '09, pp. 300-304, Oct. 20-23, 2009, Changsha, Hunan, China.

*Primary Examiner* — Gustavo Rosario Benitez
(74) *Attorney, Agent, or Firm* — John R. Pessetto; Charles A. Brill; Frank D. Cimino

(57) ABSTRACT

A simple bandgap current generator combines a PTAT (proportional to absolute temperature) base-emitter voltage (VBE) measured across two binary junction devices (ΔVBE=VBE1−VBE2) with a current that is varied by an nWell resistor with a positive temperature coefficient to produce a CTAT (complementary to absolute temperature) current instead of PTAT reference current. One of the base-emitter voltages is constrained to be VBE1=VBE (1βT). This reduces the temperature dependency of a reference current generated by the bandgap generator. This reference current may be used to generate a bandgap reference voltage by adding an IR drop to a diode voltage or to a base-emitter voltage. The simple bandgap circuit is significantly smaller in size than a precision bandgap circuit, but still provides a voltage and/or a current reference signal having a good accuracy.

14 Claims, 4 Drawing Sheets

(56) References Cited

U.S. PATENT DOCUMENTS

| | | | | |
|---|---|---|---|---|
| 2005/0285666 | A1* | 12/2005 | Garlapati | G05F 3/267 327/539 |
| 2007/0030050 | A1* | 2/2007 | Lee | G05F 3/30 327/513 |
| 2007/0252573 | A1* | 11/2007 | Tachibana | G05F 3/30 323/313 |
| 2009/0108918 | A1* | 4/2009 | Chellappa | G05F 3/30 327/539 |
| 2010/0079198 | A1* | 4/2010 | Nishi | G05F 3/30 327/513 |
| 2011/0267133 | A1* | 11/2011 | Kumar | G05F 3/30 327/512 |
| 2013/0265083 | A1* | 10/2013 | Lin | G05F 3/30 327/103 |

* cited by examiner

BANDGAP CIRCUIT FOR CURRENT AND VOLTAGE

FIELD OF THE INVENTION

This invention generally relates generating a voltage or current reference, and in particular to a bandgap circuit to generate a reference current and voltage.

BACKGROUND OF THE INVENTION

A bipolar junction transistor (BJT) is a type of transistor that relies on the contact of two types of semiconductor for its operation. BJTs may be used as amplifiers, switches, or in oscillators, for example. Charge flow in a BJT is due to bidirectional diffusion of charge carriers across a junction between two regions of different charge concentrations. The regions of a BJT are typically called emitter, collector, and base. A discrete transistor has three leads for connection to these regions.

The bandgap is the energy difference between the top of the valence band and the bottom of the conduction band in insulators and semiconductors. There is virtually no bandgap in most metals, but a very large one in an insulator or dielectric. In a semiconductor, the bandgap is small. Technically, the bandgap is the energy it takes to move electrons from the valence band to the conduction band. A bandgap reference voltage is a voltage reference based on this property.

A high precision bandgap voltage reference is a temperature independent voltage reference circuit widely used in integrated circuits, usually with an output voltage around 1.25 V.

A translinear circuit is a circuit that carries out its function using the translinear principle. These are current-mode circuits that can be made using transistors that obey an exponential current-voltage characteristic—this includes BJTs and CMOS transistors in weak inversion. By using this exponential relationship, this class of circuits can implement multiplication, amplification and power-law relationships, for example.

BRIEF DESCRIPTION OF THE DRAWINGS

Particular embodiments in accordance with the invention will now be described, by way of example only, and with reference to the accompanying drawings.

Figure 1:
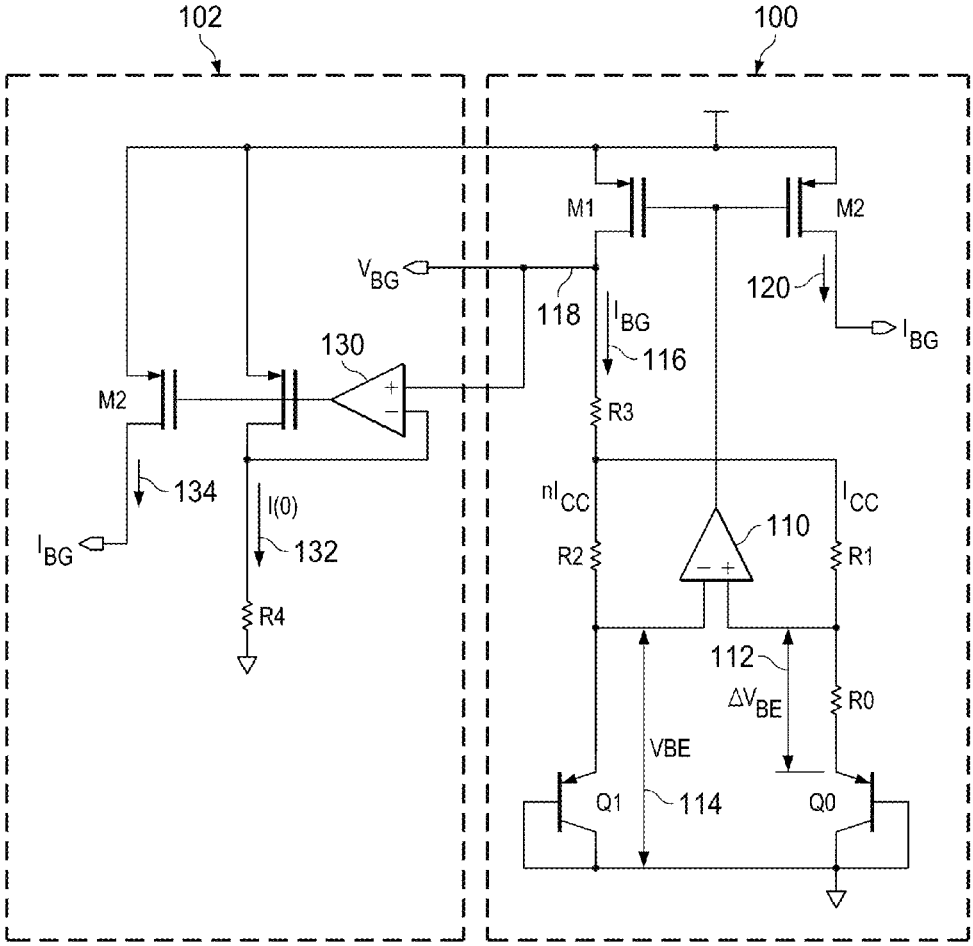
FIG. 1 (PRIOR ART)
FIG. 1 is a schematic of a prior art precision bandgap voltage reference circuit.

Other features of the present embodiments will be apparent from the accompanying drawings and from the detailed description that follows.

DETAILED DESCRIPTION OF EMBODIMENTS OF THE INVENTION

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

A traditional precision bandgap circuit first generates a bandgap voltage and then creates a reference current using a voltage to current (V2I) converter. The bandgap voltage may have a precision ±0.5%, for example. However, the reference current may have a large variation over temperature unless further compensation measures are provided. A traditional bandgap circuit typically requires one or two op amps which in turn results in a large area footprint in an integrated circuit application.

However, many integrated circuit (IC) applications that need a reference current or voltage do not need an extremely precise value; often a lower precision in the range of ±2% is sufficient for a phase locked loop (PLL) for a clock circuit in a microcontroller unit (MCU), for example. A low drop out (LDO) voltage regulator or other calibration algorithms may only require ±5% accuracy, for example. Embodiments of a relaxed accuracy bandgap reference circuit as described in more detail below may be significantly smaller in footprint area and power consumption. Embodiments of a reduced size bandgap reference circuit described herein generate both current and voltage and thereby may replace both a traditional bandgap reference circuit and a V2I circuit.

A traditional bandgap circuit uses either a VBG/R or ΔVBE/R method to generate a bias current (Ibias). VBG (bandgap voltage) is a temperature independent voltage. A resistor (R) implemented as an nWell resistor has a relatively high 2nd order temperature coefficient ($\alpha 2$). A resistor implemented using another material may have a relatively large 1st order temp coefficient ($\alpha 1$). Therefore, when using the VBG/R method, the resultant current may have both a 1st order and 2nd order temperature coefficient resulting from $R(1+\alpha 1T+\alpha 2T^2)$.

ΔVBE (delta base emitter voltage) is known as a PTAT voltage (Proportional to absolute temperature). In a typical implementation of the ΔVBE/R method, the first order temperature coefficient from the resistor may be partially cancelled; however, a 2nd order temperature coefficient may still be present.

Embodiments of the invention use the ΔVBE/R method and provide a technique for compensating for the second order temperature coefficient from the resistor. Embodiments of the invention add a $1+\beta T$ factor to the ΔVBE/R function in a simple manner such that the overall size and power consumption of a bandgap reference circuit is significantly reduced.

FIG. 1 is a schematic of a well known prior art precision bandgap voltage reference circuit 100 and an associated V2I circuit 102. Bandgap reference 100 uses two binary junction transistors (BJTs) Q0, Q1 to generate two base emitter voltages (VBE). Q1 has a smaller collector region than Q0, so the current density in Q1 is larger than in Q0 for a similar current. Therefore, a delta VBE 112 may be produced across resistor R0 that is approximately equal to VBE(Q1)−VBE (Q2). The current through resistor R0 is proportional to absolute temperature (PTAT). Op amp 110 amplifies an error signal and controls CMOS (complementary metal oxide semiconductor) transistor M1 to produce current 116 that flows through resistor R3 and is then split between resistors R1/R2. The voltage generated across resistors R2 and R3 is added to VBE voltage 114 to form the bandgap reference voltage VBG 118. The voltage across a junction operated at constant current is complementary to absolute temperature, with a change of approximately −2 mV/K. If the ratio between the resistor R0 and resistors R2, R3 is chosen properly, the first order effects of the temperature dependency of BJT Q1 and the PTAT current may approximately cancel out. The resulting voltage may be about 1.2-1.3 V, depending on the particular technology and circuit design, and may be close to the theoretical 1.22 eV bandgap of silicon at 0 K. The bandgap voltage may have a precision of ±0.5% across a temperature range of −40 C to 125 C, for example.

CMOS transistor M2 forms a current mirror with transistor M1 and therefore may provide a reference current 120, but the value of current and its temperature coefficient are not controlled. If a defined value of reference current is needed, V2I circuit 102 may be used to convert reference voltage VBG 118 to reference current IBG 134 using op amp 130 and resistor R4. The resultant current may have a negative temp coefficient: IBG=I(0)(1−α1T−α2T2), where coefficient α1, α2 are a function of resistor R4. nWell resistor R4 causes V2I current 134 to decrease with temperature which is very detrimental for amplifiers, since amplifiers prefer a PTAT current to maintain a constant Gm across temperature. In a typical IC process, this may result in a variation of up to 25% across a temperature range of −40 C to −125 C, for example.

In a typical semiconductor process, a phase locked loop (PLL) oscillator may have a footprint of 225 u×275 u=0.061 $mm^2$. A reference voltage is needed to control the PLL. A high precision bandgap reference 100 may be used to provide the reference voltage for the PLL, but it may have a footprint of 200 u×160 u=0.032 $mm^2$ and is therefore approximately ⅓ of the combined footprint. If V2I circuit 102 is required, the foot print is extended even more. Thus, precision bandgap reference circuit 100/102 is expensive in terms of semiconductor real estate and power usage.

Figure 2:
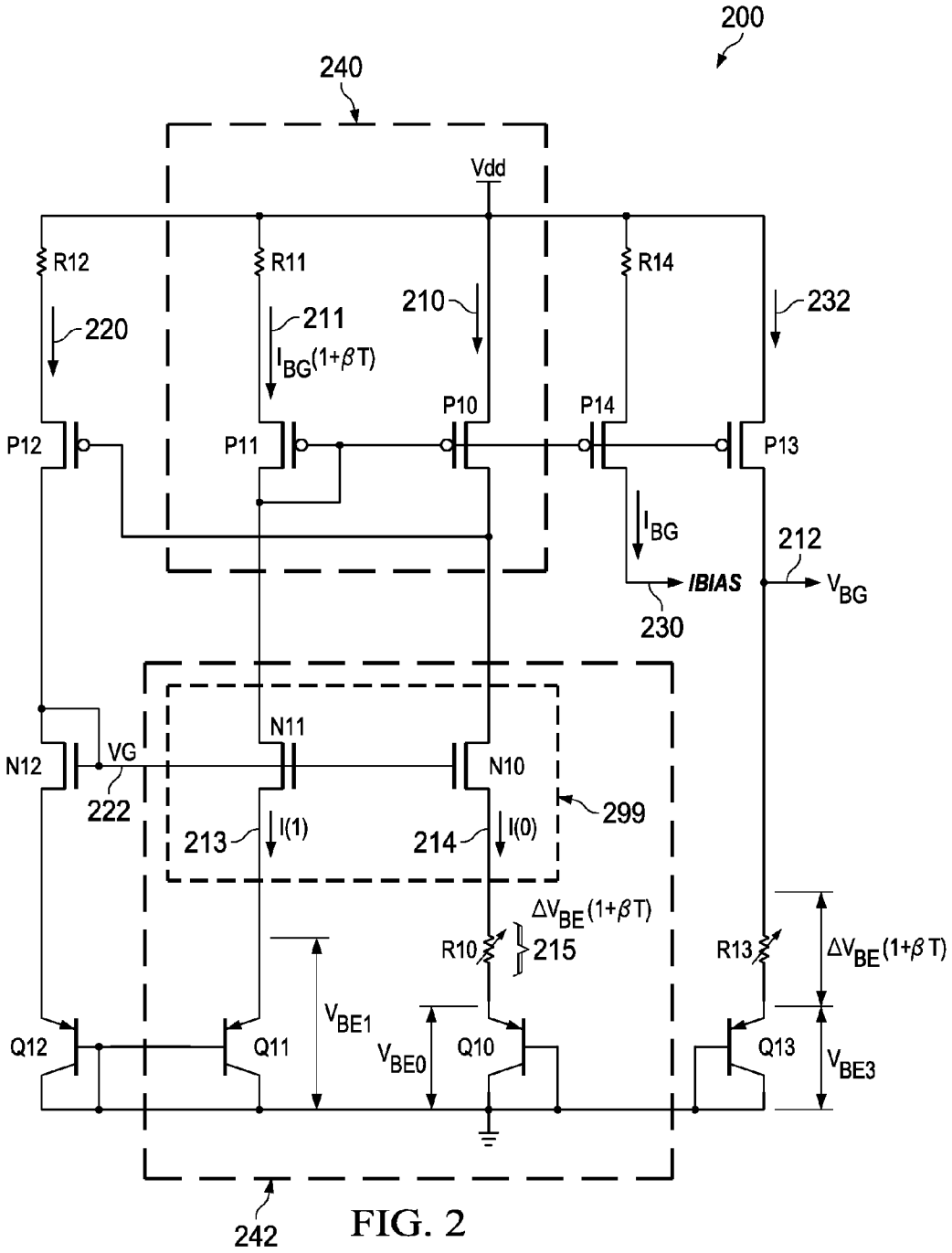
FIG. 2 is a schematic of an example reduced size bandgap current and voltage reference circuit.

FIG. 2 is a schematic of a reduced size bandgap current and voltage reference circuit 200 that is an embodiment of the present invention. Bandgap circuit 200 first generates a reference current 210 and then generates a reference voltage 212 that is responsive to the bias current. This eliminates the need for a second op amp which is used inside the V2I converter of FIG. 1.

Bandgap reference 200 uses two BJTs Q10, Q11 to generate two base emitter voltages, VBE0, VBE1, respectively. Q11 has a smaller collector region than Q10, so the current density in Q11 is larger than in Q10 for a similar current. Therefore, for a similar current, current density in Q11 will be higher than in Q10 and VBE1 will therefore be higher across Q11 than VBE0 across Q10. A delta VBE 214 may therefore be produced across resistor R10 that is approximately equal to VBE1−VBE0 which is approximately equal to the Boltzmann constant, kT/q.

nWell resistor R10, by its nature, has a positive temperature coefficient; therefore (V.sub.BE1−V.sub.BE2)/R10 does not give a PTAT current increase, but instead it has slight CTAT (complimentary (inverse) to absolute temperature) nature. This CTAT nature is corrected by making the V.sub.BE1 approximately equal to V.sub.BE(1+.beta.T), as will be shown in equation (2). As a result, a near constant Bandgap current 210 is provided by the open loop structure. N-channel MOS (NMOS) transistor N12 is used to generate a DC gate bias voltage (V.sub.G) 222 that is equal to the base-emitter voltage (V.sub.BE) of transistor Q12 plus the gate-source voltage (V.sub.GS) of NMOS transistor N12 above ground. The size of Q12 and N12 may be scaled based on current following through them with respect to NMOS transistors N1, NO and BJTs Q11, Q10. Gate bias voltage V.sub.G 222 is used to bias the gates of transistor N11 and N10. Since the gates of N11 and N10 are connected together and held at constant voltage and input is provided at the respective sources 213, 214, they operate as a common gate amplifier 299. The size of N11 and N10 are designed to be proportional to the current following through them. This will result in a same voltage (Vs) at each of their source terminals 213, 214 even though two different currents 211, 210 may be flowing through them.

Currents I(1) 211 and I(0) 210 respectively flow through PNP transistors Q11 and Q10. The base-emitter cross-sectional area of Q11 and Q10 is A1 and A0 respectively. Q11, N11, N10, resistor R10, and Q10 operate as a translinear loop 242. The voltage drop across resistor R10 becomes the difference between the base-emitter voltage ($V_{BE}$) of Q11 and Q10 and may be defined according to equation (1). ΔVBE is known as a PTAT (Proportional to absolute temperature) voltage.

$$\Delta V_{BE}=KT/q*\ln((I(1)\times A0)/(I(0)\times A1)) \quad (1)$$

where: ln((I(1)×A0)/(I(0)×A1)) is a constant multiplying factor.

P-Channel MOS (PMOS) transistors P12 and P10 form a current mirror with transistor P11 and are used to bias the transistor Q2, Q1, Q0 respectively with a fixed current ratio.

Ignoring resistors R12, R11, and R14, this circuit may be similar to a typical PTAT generator circuit. Embodiments of the invention add provide a low cost temperature compensation factor, 1+βT, where β is a temperature coefficient value and T represents temperature. In order to do so, another translinear loop (LP1) 240 is formed using transistor P10, P11 and R11. P11 is made much larger than the ratio of (I(1)/I(0)) of current flowing through P11 and P10. This reduces the VGS voltage required by P11 to allow current I(1) to flow through it. Thus, a voltage is generated across resistor R11 which is equal to VGSP0−VGSP1, where VGSP0 and VGSP1 are gate source voltage for transistor P0 and P1 respectively. Current I(1)=ΔVGS/R11 which gives it a PTAT nature as described above. This PTAT nature is then used to compensate the PTAT nature of AVBE generated by translinear loop LP0 242. The positive temp coefficient produced by translinear loop LP1 is referred to as βT to distinguish it from the positive temperature coefficient αT of translinear loop LP0 242.

In a traditional bandgap voltage circuit, transistors Q11 and Q10 would be biased from a same current with a fixed current ratio. In this embodiment, Q11 is biased with a current 211 that has an additional PTAT nature to it with respect to current 210 that is biasing Q10. Hence, a resultant voltage across transistor Q11 may be represented by equation (2) with an additional PTAT coefficient 1+βT.

$$VBE1'=VBE1(1+\beta T) \quad (2)$$

A resultant voltage across resistor R10 may now be expressed by equation (3).

$$\Delta VBE=KT/q*\theta*(1+\beta T),\ \text{where}\ \theta=\ln((I(1)\times A0)/(I(0)\times A1)). \quad (3)$$

Bandgap reference current I(0) 210 may then be represented by equation (4).

$$I_{BG} = \frac{\frac{KT}{q}\partial(1+\beta T)}{R_{10}(1+\alpha_1 T+\alpha_1 T^2)} \quad (4)$$

As can be seen from equation (4), both numerator and denominator for bandgap reference current 210 have a T and $T^2$ term. Therefore, by careful selection of temperature coefficients α and β, reference current 210 may be formed in a manner that is reasonably constant over temperature.

In this embodiment, in order to generate a voltage from bandgap reference current 210, all that is needed is $V_{BE3}$+ I×R13. PMOS transistor P13 acts as a current mirror with PMOS transistor P10 such that a mirror current I 232 is formed that is equal to reference current 210. As is well known, VBE has a complementary to absolute temperature (CTAT) nature and I×R13 is a buffered value of AVBE voltage which is PTAT in nature. When these terms are added, the CTAT effect may cancel the PTAT effect and a voltage may be produced that is approximately constant with respect to temperature. In this embodiment, an additional term 1+βT is applied to ΔVBE, which may cause some loss of accuracy, in the range of ±2%-±5%, example. However, 2%-5% accuracy over a temperature range of −40 C to 125 C will still meet the requirement of most commercial and consumer systems. VBG 212 may have a tolerance of ±1.5% by appropriate trimming of resistors R10, R12, for example.

Additional current mirrors may be added to provide additional copies of a reference current. For example, PMOS transistor P14 and resistor R14 provide a mirror copy 230 of bandgap bias current 210.

Figure 3:
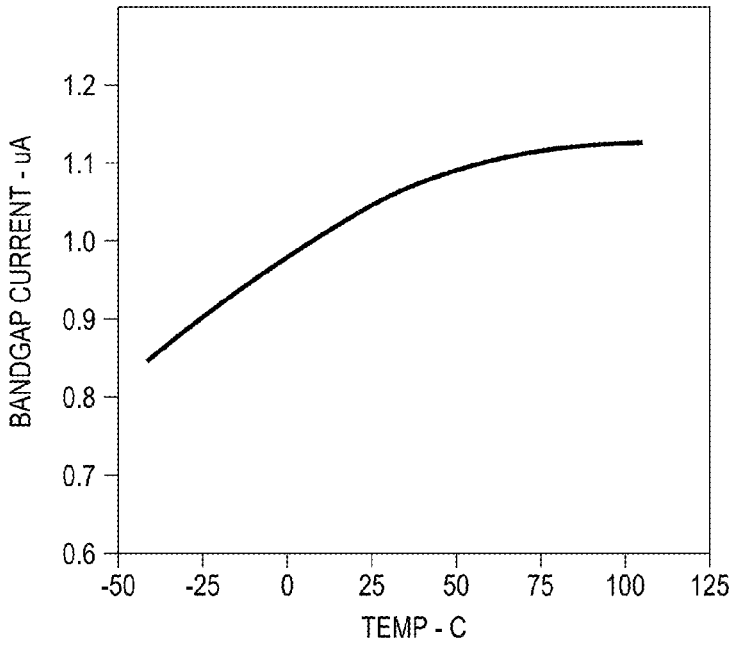
FIG. 3 is a plot of current vs. temperature for the example reference circuit of FIG. 2.

FIG. 3 is a plot of current vs. temperature for the example reference circuit 200. From equation (4), it can be demonstrated that reference circuit 200 is able to produce a bandgap reference current 210 that has a tolerance of +15% &-10% across a temperature range of −40 C-125 C in an example implementation based on temperature coefficients α and β. PMOS device P14 forms a current mirror to produce a bandgap reference current 230 that may be provided to bias other components in a system, such as amplifiers, oscillators, etc.

For embodiments that need a strictly PTAT current reference, this current may be adjusted by selecting temperature coefficients α and β to get a PTAT current instead of a CTAT current to keep constant Gm in an amplifier.

In many analog systems, it is preferred to use a bandgap reference current rather than a voltage as a reference since a current may be distributed across a hostile environment with less degradation from coupling than a voltage. Additional current mirrors may be added to provide multiple bandgap reference current signals.

Bandgap circuit 200 may be implemented in an area that is significantly reduced in size from prior art circuit 100. For example, using a same process that was used to form circuit 100, circuit 200 may be implemented in an area of 110 u×55 u=0.005 $mm^2$. This is only 20% of the area needed for circuit 100, (0.032 $mm^2$).

Since reference circuit 200 may be implemented in such a small area, an integrated circuit design may be able to afford using multiple reference circuits that are each located adjacent or near to a circuit that needs the reference current or voltage. In this manner, operation of an integrated circuit may be improved by reducing the potential for interference being coupled onto a reference signal.

Figure 4:
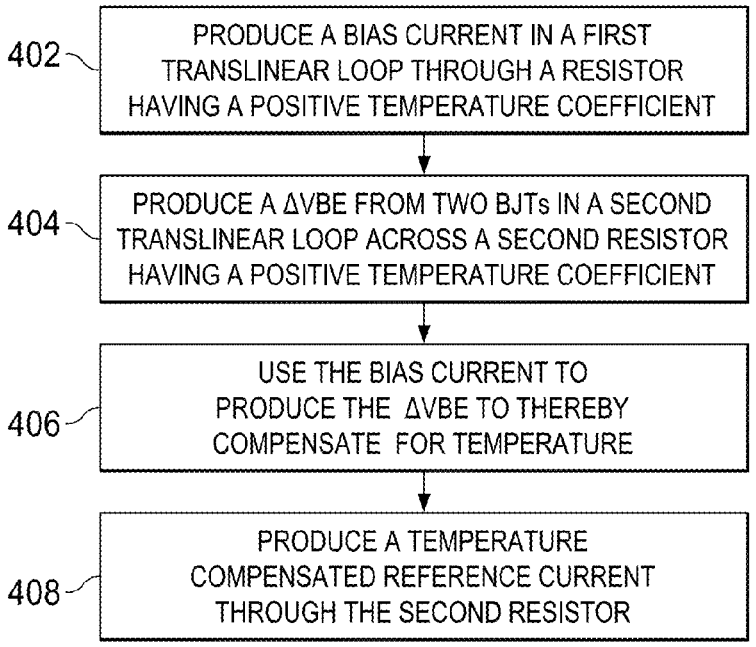
FIG. 4 is a flow diagram illustrating operation of a reduced size bandgap reference circuit.

FIG. 4 is a flow diagram illustrating operation of a reduced size bandgap reference circuit. A bias current is produced 402 through a first resistor having a positive temperature coefficient in a first translinear loop such that the bias current has a positive temperature coefficient.

A delta base emitter voltage (VBE) is produced 404 between a first bipolar junction transistor (BJT) having a higher VBE and a second BJT having a lower VBE across a second resistor in a second translinear loop, wherein the second resistor has a positive temperature coefficient.

The bias current produced by the first translinear loop is used 406 to bias the first BJT of the second translinear loop, wherein the positive temperature coefficient of the bias current compensates for the positive temperature coefficient of the second resistor.

A temperature compensated reference current is produced 408 through the second resistor responsive to the delta VBE. Mirror copies of the reference current may be produced. For example, a mirror copy of the reference current may be used to produce a temperature compensated reference voltage across a resistor connected in series to a third BJT.

System Example

Figure 5:
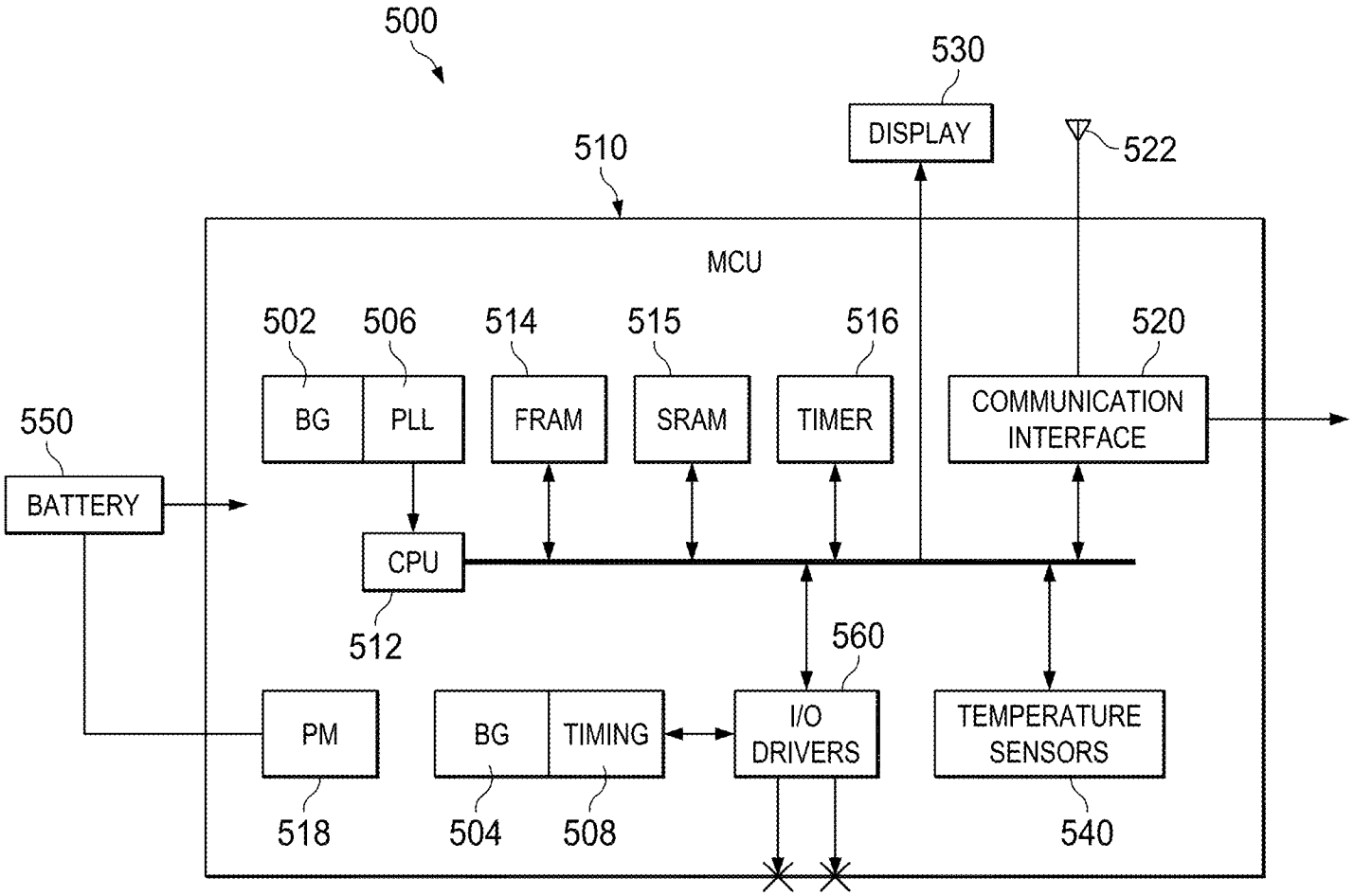
FIG. 5 is a block diagram of an example system that utilizes a reduced size bandgap reference.

FIG. 5 is a block diagram of a microcontroller unit (MCU) based system 500 that makes use of reduced size bandgap reference circuits, such as bandgap reference 502 and 504. System 500 includes a microcontroller (MCU) 510 that may include an FRAM (ferroelectric random access memory) storage module 514, a static random access memory 515, and one or more timer modules 516. MCU 510 may also include various interfaces for coupling to a display 530, and one or more temperature sensors 540 or other types of known or later developed sensors. In some embodiments, MCU 510 may also include a communications interface 520 to allow wired or wireless reporting and/or communication with another system.

The design and operation of MCU based systems are well known and need not be described in detail herein. Various embodiments may include various subsystems, such as, for example: A/D converter, multi-channel comparator with voltage reference generation and hysteresis capabilities, serial channels capable of 120, SPI, or UART protocols, internal DMA, hardware multiplier, real-time clock, 16-bit timers, etc. MCU based systems may be used to provide control or sensing in all manner of residential, manufacturing, medical, and automotive uses, for example. MCU based systems may be used in stationary systems or in mobile commercial or consumer products, such as smart phones, pads, tablets personal computers, etc., for example.

Communications interface 520 may include a transmitter and a receiver for wireless communication with an external data collection system. Interface 520 may communicate using RF standards such as ZigBee, which is popular in low data rate, low power applications. ZigBee and other low power RF standards use MAC and PHY layers defined by IEEE 802.15.4. An amendment to 802.15.4, called 802.15.4e uses a duty-cycled MAC to reduce radio power consumption.

Display 530 may be a simple set of LEDs (light emitting diodes), or a more complex LCD (liquid crystal display), for example. In some embodiments, display 530 may be omitted.

This example includes a temperature sensor 540 for sensing air temperature. However, various embodiments may include a wide range of known or later developed sensors that may be used to collect various types of environmental data. This example of MCU 510 includes a 500-ksps 10-bit ADC and 2 op-amps that may be used to gather and process environmental data from sensors 540.

Battery 550 provides power to MCU 510, communication interface 520, display 530 and sensors 540. Power management (PM) logic 518 may be included within MCU 510, or it may be separate. PM logic 518 may be configured to control power levels provided to MCU 510, communications interface 520, display 530, and sensors 540. Various schemes for controlling and changing power consumption by various domains within an integrated circuit and multichip system that are now known or later developed may be used by PM 518. For example, this may include raising or lowering voltage levels provided by battery 550 to the various components. This may also include changing a clock rate provided to MCU 510 by phase locked loop (PLL) 506.

Timing logic 508 may be configured by CPU 512 to generate timing signals to control the operation of drivers 560.

In this embodiment of the invention, reduced size bandgap circuit 502, as described in more detail above, provides an adequate reference current for use by PLL circuit 506 (an analog circuit) that provides a variable clock for CPU 512. Similarly, reduced size bandgap circuit 504, as described in more detail above, provides an adequate reference current for use by timing circuit 508 (a second analog circuit).

MCU system 510 may include additional reduced size bandgap circuits that may be located adjacent or nearby other subsystems to provide a reference voltage or current. The small size of reduced size bandgap reference circuits as described herein allow them to be placed as needed in a system to simplify the design of the system.

Other Embodiments

While the invention has been described with reference to illustrative embodiments, this description is not intended to be construed in a limiting sense. Various other embodiments of the invention will be apparent to persons skilled in the art upon reference to this description. For example, multiple current mirrors may be used to generate multiple bandgap current reference signals. Multiple bandgap reference circuits may be deployed on a single integrated circuit due to their small size.

Various configurations of the reduced size bandgap circuit may be designed. For example, the translinear loop that generates the bias current may be formed using BJT devices instead of MOS devices. BJT devices Q11, Q10 may be implemented as simple diodes in some embodiments. In some embodiments, NPN BJTs may be used in place of PNP device Q11, Q10 by essentially inverting the circuit and reconfiguring the bias translinear loop accordingly.

Embodiments of a reduced sized bandgap reference and methods described herein may be used in all manner of applications, e.g.: various monitoring and process control systems in manufacturing, transportation, and business applications; electronic thermostats and heating and air conditioning control systems; thermometers; fixed and mobile computing system, personal digital assistants such as tablets, pads or smart phones; etc, for example.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A method for operating a bandgap reference circuit, the method comprising: producing a bias current through a first resistor having a positive temperature coefficient in a first translinear loop such that the bias current has a positive temperature coefficient;

producing a delta base emitter voltage (VBE) between a first bipolar junction transistor (BJT) having a higher VBE and a second BJT having a lower VBE across a second resistor in a second translinear loop, wherein the second resistor has a positive temperature coefficient;

using the bias current produced by the first translinear loop to bias the first BJT of the second translinear loop, wherein the positive temperature coefficient of the bias current compensates for the positive temperature coefficient of the second resistor; and producing a temperature compensated reference current through the second resistor responsive to the delta VBE; and wherein the second translinear loop comprises the first and the second BJT as two base connected BJTs coupled to inputs of an amplifier, wherein the second resistor is connected between a first input of the amplifier and an emitter of one of the BJTs.

2. The method of claim 1, wherein a temperature coefficient of the compensated reference current is less than approximately +/−5%.

3. The method of claim 1, wherein the first translinear loop comprises two gate connected metal oxide semiconductor (MOS) transistors, wherein a drain of one of the two gate connected MOS transistors is coupled to the first resistor.

4. The method of claim 1, wherein the first translinear loop comprises two BJTs, wherein a collector of the one of the two BJTs is coupled to the first resistor.

5. The method of claim 1, wherein the second translinear loop comprises the first and the second BJT as two base connected BJTs coupled to two gate connected N-Channel metal oxide semiconductor (NMOS) transistors, wherein the second resistor is connected between a source of one of the NMOS transistors and an emitter of one of the first and second BJTs.

6. The method of claim 1, further comprising making a mirror copy of the compensated reference current.

7. The method of claim 1, further comprising using a mirror copy of the compensated reference current to produce a temperature compensated reference voltage across a resistor connected in series to a third BJT.

8. A bandgap reference circuit comprising:

a first translinear loop having a control node of a first semiconductor device connected to a control node of a second semiconductor device with a first resistor connected to an input node of the first semiconductor device;

a second translinear loop having a control node of a third semiconductor device connected to a control node of a fourth semiconductor device with a second resistor connected to an input node of the fourth semiconductor device; and wherein the first translinear loop is coupled to the second translinear loop such that a bias current produced in the first resistor flows through the first semiconductor device and through the third semiconductor device and a reference current is produced that flows through the second semiconductor device, the second resistor, and the fourth semiconductor device, wherein the bias current flows in accordance with a positive temperature coefficient and compensates for the positive temperature coefficient of the second resistor; and wherein the second translinear loop further comprises an amplifier with a first input coupled to the third semiconductor device and a second input coupled to the second resistor.

9. The bandgap reference circuit of claim 8, wherein the second translinear loop further comprises two gate connected metal oxide semiconductor (MOS) devices coupled between the third semiconductor device and the second resistor.

10. The bandgap reference circuit of claim 8, wherein the first and second semiconductor devices are metal oxide semiconductor (MOS) transistors.

11. The bandgap reference circuit of claim 8, wherein the first and second semiconductor devices are bipolar junction transistors.

12. The bandgap reference circuit of claim 8, further comprising a mirror circuit configured to produce a copy of the reference current.

13. The bandgap reference circuit of claim 8, further comprising a mirror circuit configured to produce a copy of the reference current through a resistor connected in series to a third BJT, whereby a voltage formed across the resistor and third BJT is a temperature compensated reference voltage.

14. A system comprising:

one or more bandgap reference circuits comprising:

a first translinear loop having a control node of a first semiconductor device connected to a control node of a second semiconductor device with a first resistor connected to an input node of the first semiconductor device;

a second translinear loop having a control node of a third semiconductor device connected to a control node of a fourth semiconductor device with a second resistor connected to an input node of the fourth semiconductor device; and wherein the first translinear loop is coupled to the second translinear loop such that a bias current produced in the first resistor flows through the first semiconductor device and through the third semiconductor device and a reference current is produced that flows through the second semiconductor device, the second resistor, and the fourth semiconductor device; and an analog circuit coupled to receive a reference output from one of the one or more bandgap reference circuits, wherein the bias current flows in accordance with a positive temperature coefficient and compensates for the positive temperature coefficient of the second resistor; and wherein the system further comprises a second analog circuit coupled to receive a reference output from a second one of the bandgap reference circuits.

* * * * *